US008939132B2

(12) United States Patent
Tanaya

(10) Patent No.: US 8,939,132 B2
(45) Date of Patent: Jan. 27, 2015

(54) IGNITION CONTROL APPARATUS

(75) Inventor: Kimihiko Tanaya, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 393 days.

(21) Appl. No.: 13/423,940

(22) Filed: Mar. 19, 2012

(65) Prior Publication Data

US 2013/0092136 A1 Apr. 18, 2013

(30) Foreign Application Priority Data

Oct. 17, 2011 (JP) ..... 2011-227646

(51) Int. Cl.

| | |
|---|---|
| ***F02P 3/00*** | (2006.01) |
| ***F02P 17/12*** | (2006.01) |
| ***F02P 15/00*** | (2006.01) |
| *F02P 3/05* | (2006.01) |

(52) U.S. Cl.

CPC ..... *F02P 17/12* (2013.01); *F02P 15/005* (2013.01); *F02P 3/053* (2013.01); *F02P 2017/123* (2013.01)

USPC ..... 123/634

(58) Field of Classification Search

CPC ..... F02P 17/12; F02P 15/005; F02P 3/053

USPC ..... 123/406.13, 406.19, 605, 618, 634

See application file for complete search history.

(56) References Cited

FOREIGN PATENT DOCUMENTS

| | | | |
|---|---|---|---|
| JP | 61-268872 | A | 11/1986 |
| JP | 10-306765 | A | 11/1998 |
| JP | 11-013620 | A | 1/1999 |
| JP | 11-030143 | A | 2/1999 |
| JP | 2002-202039 | A | 7/2002 |
| JP | 3917185 | B2 | 5/2007 |
| JP | 2011-137400 | A | 7/2011 |
| JP | 2011-149406 | A | 8/2011 |
| WO | 97/43544 | A1 | 11/1997 |

OTHER PUBLICATIONS

Japanese Office Action dated Oct. 16, 2012, issued in JP Application No. 2011-227646.

*Primary Examiner* — Hai Huynh
(74) *Attorney, Agent, or Firm* — Sughrue Mion, PLLC

(57) ABSTRACT

Ignition is performed in such a way that a bias voltage is applied to a first electrode of an ignition plug and a current detection device detects a current that flows in the first electrode, that based on the value of the detected current, a smolder level detection device detects the level of a smolder produced in the ignition plug, and that a control device controls, based on the detected smolder level, at least one of the timing of ignition, the number of ignition events per power stroke of an internal combustion engine, and the amount of energy accumulated in an ignition coil device.

1 Claim, 5 Drawing Sheets

IGNITION CONTROL APPARATUS

BACKGROUND OF THE INVENTION

1. Field of the Invention

The present invention relates to an ignition control apparatus that controls ignition of an internal combustion engine mainly utilized in a vehicle.

2. Description of the Related Art

In recent years, the issues such as environment preservation and fuel depletion. have been raised; measures for these issues are urgently required also in the automobile industry. The measures include, as an example, ultra-lean-combustion (sometimes referred to as stratified-lean-combustion) operation of an internal combustion engine that utilizes a stratified air-fuel mixture. However, in the stratified-lean-combustion operation of an internal combustion engine, the distribution of inflammable fuel-air mixtures may vary in the combustion chamber of the internal combustion engine; therefore, there exists a problem that the ignition plug is liable to smolder. In particular, in spray-guide-type stratified-lean-combustion operation where an unburned fuel is directly sprayed toward an ignition plug, smolder of the ignition plug occurs conspicuously.

When an ignition plug smolders, the ignition energy leaks to the ground level (referred to as a GND level, hereinafter) through conductive carbon or iron oxide that form the smolder, and hence the gap between a center electrode, which is a first electrode of the ignition plug, and a second electrode of the GND level is not led to a breakdown (sometimes referred to as a flashover, hereinafter); therefore, no spark discharge occurs, or it takes a superfluous time by the time the gap is led to a flashover where a spark discharge occurs. As a result, there is posed a defect that, for example, the output decreases because the actual ignition timing is delayed. Moreover, it takes a superfluous time by the time the gap is led to a flashover where a spark discharge occurs; thus, even should the gap between the electrodes of the ignition plug is led to a flashover, the spark discharge can be maintained just for a short time. As a result, there has been a problem that because ignition of the inflammable fuel-air mixture is not stabilized, the ignition performance or the combustion performance is deteriorated.

Furthermore, because in recent years, there has been a tendency that an ignition plug becomes slimmer or becomes to have a longer reach, the to-the-ground static capacity of the ignition plug is likely to increase; therefore, along with the effect of an increase, in the required voltage for the ignition plug, that is caused by an increase in the compression ratio of an internal combustion engine, the creation of an energy leak path due to the smolder of the ignition plug has been more and more affecting the ignition performance of the internal combustion engine.

Accordingly, in order to solve the foregoing problems caused by the smolder of an ignition plug, there has been proposed an ignition apparatus disclosed in Patent Document 1. In the conventional ignition apparatus disclosed in Patent Document 1, even at the timing when no combustion of an inflammable fuel-air mixture is carried out, the ignition plug performs a spark discharge so that a smolder of the ignition plug is prevented from developing and the smolder is burned out.

PRIOR ART REFERENCE

Patent Document

[Patent Document 1] Japanese Patent No. 3917185

However, although it can decrease the frequency of occurrence of a ignition-plug smolder, the conventional ignition apparatus disclosed in Patent Document 1 cannot completely suppress or remove the smolder; thus, there still exists the problem that the occurrence of a smolder deteriorates the ignition performance or the combustion performance.

SUMMARY OF THE INVENTION

The present invention has been implemented in order to solve the foregoing problems in a conventional ignition apparatus; the objective thereof is to provide an ignition control apparatus that can securely produce a spark discharge even when a smolder is produced in an ignition plug.

An ignition control apparatus according to the present invention includes an ignition plug that is provided with a first electrode and a second electrode that face each other by the intermediary of a gap and that produces a spark discharge in the gap so that a inflammable fuel-air mixture inside a combustion chamber of an internal combustion engine is ignited, when a predetermined high voltage is applied to the first electrode; an ignition coil device that generates the predetermined high voltage, by accumulating energy and releasing the accumulated energy, and that applies the generated predetermined high voltage to the first electrode; a current detection device that applies a bias voltage to the first electrode and detects a current that flows in the first electrode based on the applied bias voltage; a smolder level detection device that detects a level of a smolder produced in the ignition plug, based on a value of the current detected by the current detection device; and a control device that controls, based on a smolder level detected by the smolder level detection device, at least one of the timing of ignition, the number of ignition events per power stroke of the internal combustion engine, and the amount of energy accumulated in the ignition coil device.

An ignition control apparatus according to the present invention is provided with a control device that controls, based on a smolder level detected by the smolder level detection device, at least one of the timing of ignition, the number of ignition events per power stroke of the internal combustion engine, and the amount of energy accumulated in the ignition coil device; therefore, ignition can securely be performed under the circumstances where a smolder is produced. As a result, extinction of the internal combustion engine is prevented so that decrease in the output is suppressed; concurrently, deleterious components can be prevented from being exhausted to the air, and increase in the consumption of the fuel can be prevented.

The foregoing and other object, features, aspects, and advantages of the present invention will become more apparent from the following detailed description of the present invention when taken in conjunction with the accompanying drawings.

DETAILED DESCRIPTION OF THE PREFERRRED EMBODIMENT(S)

Embodiment 1

Figure 1:
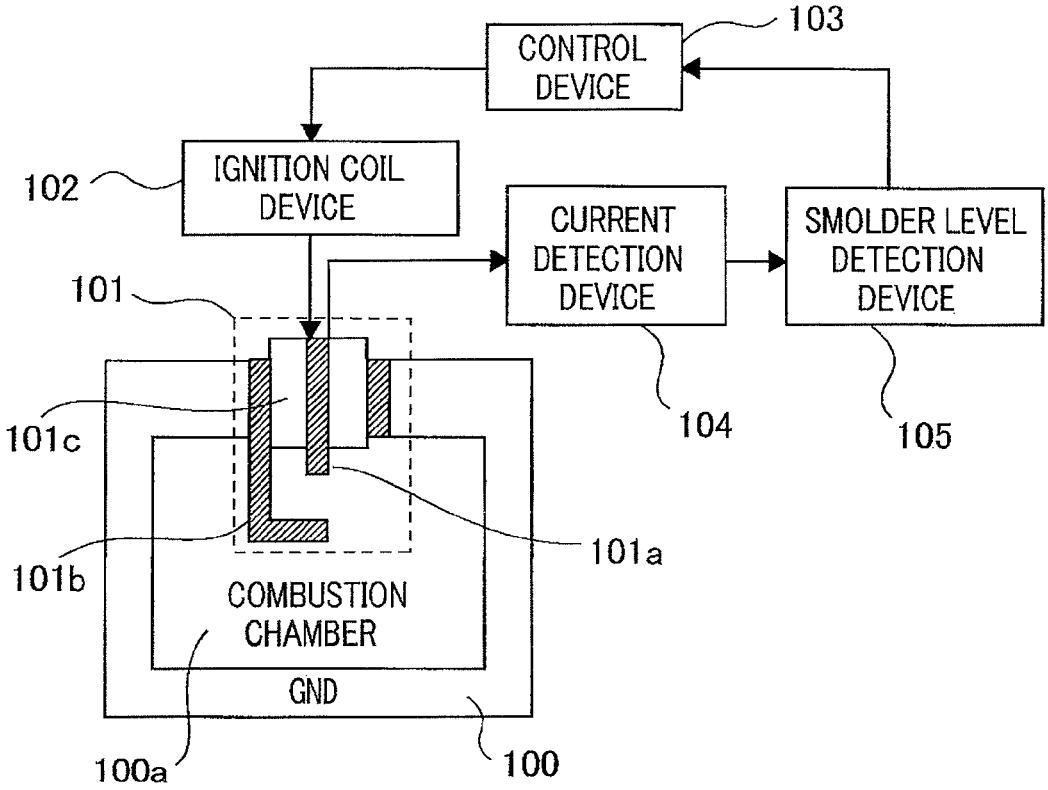
FIG. 1 is a configuration diagram illustrating an ignition control apparatus according to Embodiment 1 of the present invention.

FIG. 1 is a configuration diagram illustrating an ignition control apparatus according to Embodiment 1 of the present invention. In FIG. 1, an ignition plug 101 mounted in an internal combustion engine 100 is provided with a central electrode 101*a* as a first electrode to which a high voltage is applied and a GND electrode 101*b* as a second electrode electrically connected with a cylinder block, which is a GND-level portion of the internal combustion engine 100. The ignition plug 101 is disposed in such a way that the central electrode 101*a* and the GND electrode 101*b* are exposed inside a combustion chamber 100*a* of the internal combustion engine 100; a predetermined high voltage for ignition is applied to the central electrode 101*a* and hence a spark discharge is produced in a gap between the central electrode 101*a* and the GND electrode 101*b*, so that an inflammable fuel-air mixture in the combustion chamber 100*a* is ignited and burned. The central electrode 101*a* and the GND electrode 101*b* are insulated from each other by means of an insulating supporter 101*c* formed, for example, of earthenware and are integrally fixed by the intermediary of the insulating supporter 101*c*.

In general, the internal combustion engine 100 mounted in a vehicle is configured as a multi-cylinder internal combustion engine provided with a plurality of combustion chambers; however, in this embodiment, only one of the plurality of combustion chambers is illustrated.

An ignition coil device 102 produces a high voltage for ignition, based on an instruction from a control device 103 and supplies the produced high voltage to the central electrode 101*a* of the ignition plug 101. A current detection device 104 produces a voltage, which is different from the high voltage for ignition, and supplies the produced voltage, as a bias voltage, to the central electrode 101*a* of the ignition plug 101; the current detection device 104 detects a current that flows, based on the supplied bias voltage, in the gap between the central electrode 101*a* and the GND electrode 101*b*, and generates an output voltage corresponding to the value of the detected current.

A smolder level detection device 105 determines the smolder level of a smolder produced in the ignition plug 101, based on the level of the output voltage from the current detection device 104, and inputs the determination result to the control device 103. The control device 103 is a device for controlling the operation of the ignition coil device 102; based on the result of smolder level determination by the smolder level detection device 105, the control device 103 controls at least one of the ignition timing, which is a timing of a spark discharge by the ignition plug 101, the number of ignition events per power stroke of the internal combustion engine 100, and the amount of energy stored in the ignition coil device 102. In the ignition control apparatus according to Embodiment 1, the control device 103 performs the foregoing control by correcting the immediately previous control amount.

Figure 2:
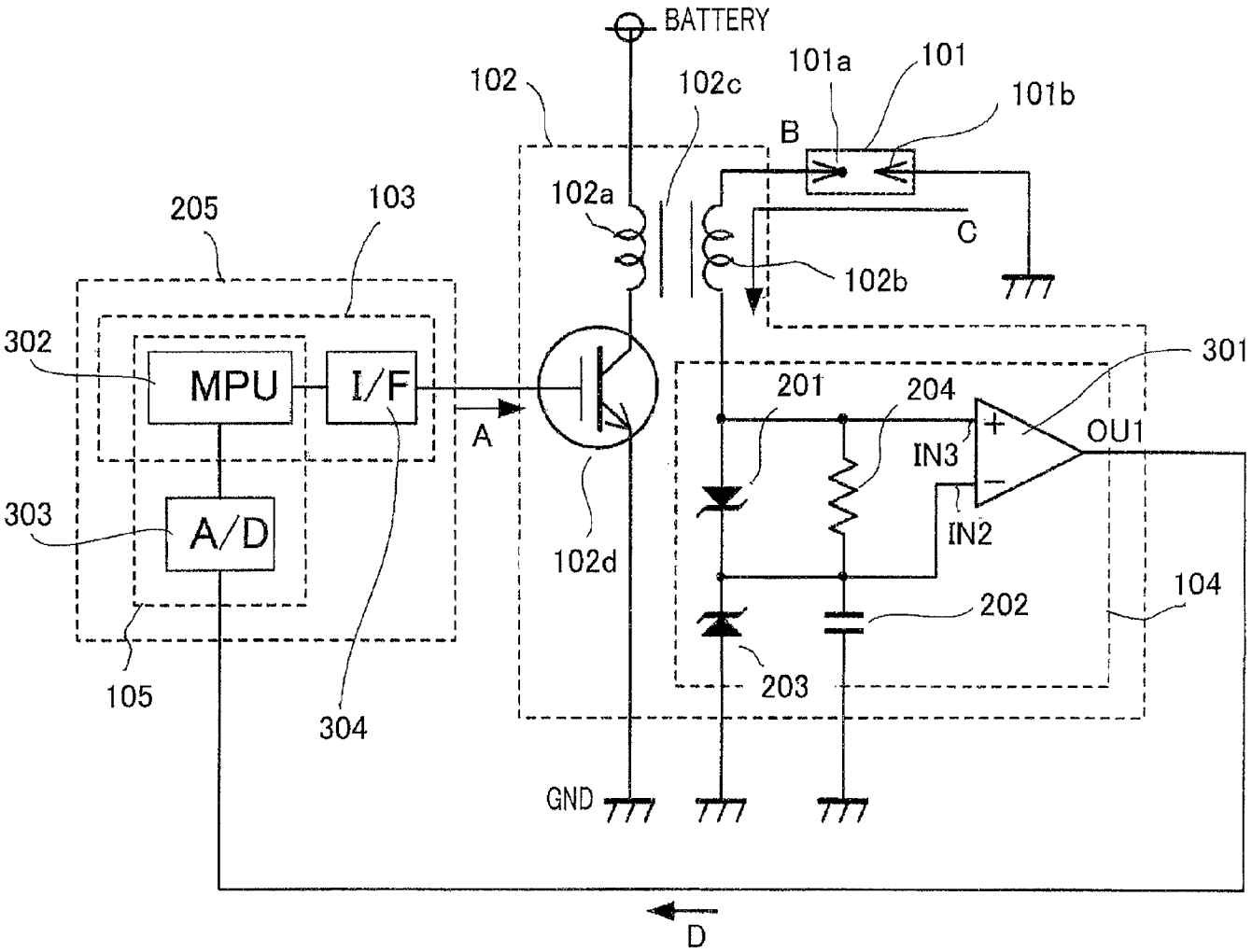
FIG. 2 is a circuit diagram illustrating an ignition control apparatus according to Embodiment 1 of the present invention.

Next, there will be explained the specific configuration of an ignition control apparatus according to Embodiment 1 of the present invention. FIG. 2 is a circuit diagram illustrating an ignition control apparatus according to Embodiment 1 of the present invention. In FIG. 2, the constituent elements corresponding to those in FIG. 1 are designated by the same reference characters. The ignition coil device 102 is configured with a primary coil 102*a*, one end of which is connected with a battery mounted in a vehicle; a secondary coil 102*b* that is magnetically coupled with the primary coil 102*a* by the intermediary of an iron core 102*c* and one end of which is connected with the central electrode 101*a* of the ignition plug 101; and IGBT 102*d*, which is a switching device whose collector is connected with the other end of the primary coil 102*a* and whose emitter is connected with the GND-level portion of the vehicle. In Embodiment 1, the package of the ignition coil device 102 integrally includes the current detection device 104, described later, that is connected between the other end of the secondary coil 102*b* and the GND-level portion of the vehicle.

The current detection device 104 is configured with a first Zener diode 201, one end of which is connected with the other end of the secondary coil 102*b* of the ignition coil device 102; a second Zener diode 203, one end of which is connected with the other end of the first Zener diode 201 and the other end of which is connected with the GND-level portion of the vehicle; a resister 204 connected across the first Zener diode 201; a capacitor 202, one end of which is connected with the connection point between the resister 204 and the second Zener diode 203 and the other end of which is connected with the GND-level portion of the vehicle; and an operational amplifier 301, the input terminal IN3 of which is connected with one end of the resister 204 and the input terminal IN2 of which is connected with the other end of the resister 204. From its output terminal OU1, the operational amplifier 301 outputs an output voltage corresponding to the voltage across the resister 204, which is inputted through the input terminals IN2 and IN3.

The smolder level detection device 105 is configured with a microprocessor (referred to as an MPU, hereinafter) 302 and an A/D converter 303; the output voltage of the current detection device 104 is converted into a digital signal by the A/D converter 303 and inputted to MPU 302. The method for smolder level detection by the smolder level detection device 105 will be described later.

The control device 103 is configured with MPU 302 and an interface circuit (referred to as an I/F circuit, hereinafter) 304, and supplies a control signal, described later, to the gate electrode of IGBT 102*d* in the ignition coil device 102.

In addition, in FIG. 2, MPU 302 is illustrated in such a way as to be shared by the control device 103 and the smolder level detection device 105; however, it poses any problem to separate the MPUs of these devices. Additionally, by arranging the control device 103 and the smolder level detection device 105 in a single and the same package or arranging the control device 103, the smolder level detection device 105, and the current detection device 104 in a single and the same package, for example, in an internal combustion engine control unit 205, the cost can be reduced and the system can be simplified.

Figure 3:
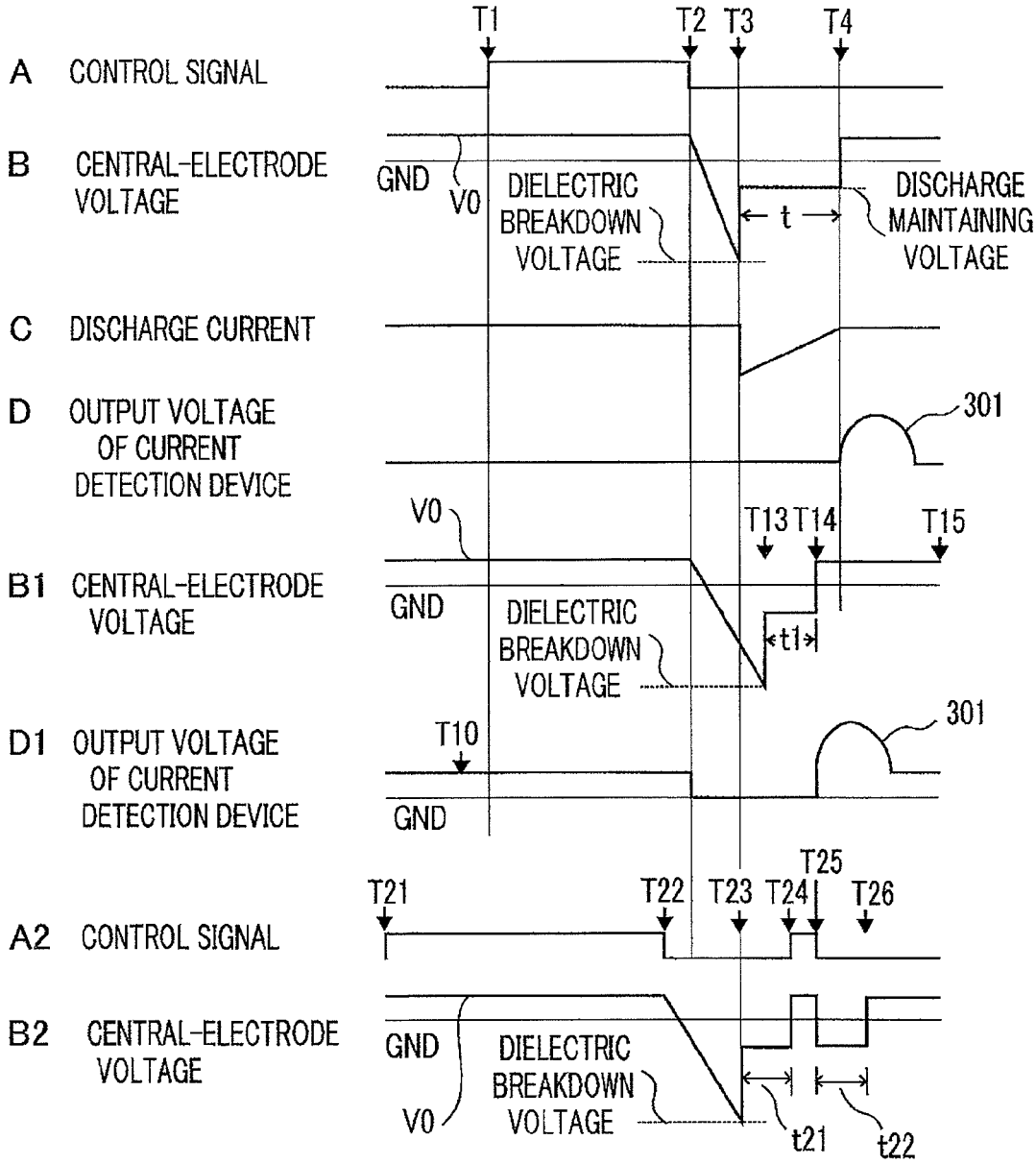
FIG. 3 is a timing chart for explaining the operation of an ignition control apparatus according to Embodiment 1 of the present invention.

Next, the operation of the ignition control apparatus according to Embodiment 1 of the present invention will be explained. FIG. 3 is a timing chart for explaining the operation of the ignition control apparatus according to Embodiment 1 of the present invention. In FIG. 3, Charts A and A2 represent the waveforms of control signals to be supplied from the control device 103 to the gate of IGBT 102*d;* Charts B, B1, and B2 represent the waveforms of central-electrode voltages to be supplied to the central electrode 101*a;* Chart C represents the waveform of a discharge current that flows in a gap between the central electrode 101*a* and the GND electrode 101*b;* and Charts D and D1 represent the waveforms of output voltages of the current detection device 104.

In FIG. 3, as far as the control signal A, the central-electrode voltage B, the discharge current C, and the output voltage D of the current detection device 104 are concerned, there are represented the respective waveforms thereof at a time when no smolder is produced in the ignition plug 101. As far as the central-electrode voltage B1 and the output voltage D1 of the current detection device 104 are concerned, there are represented the respective waveforms thereof at a time when a smolder is produced in the ignition plug 101 and the ignition control apparatus according to Embodiment 1 of the present invention is not applied. As far as the control signal A2 and the central-electrode voltage B2 are concerned, there are represented the respective waveforms thereof at a time when a smolder is produced in the ignition plug 101 and the ignition control apparatus according to Embodiment 1 of the present invention is applied.

At first, the case where no smolder is produced in the ignition plug 101 will be explained. In FIGS. 2 and 3, the control signal A generated by MPU 302 of the control device 103 is supplied, by way of the I/F circuit 304, to the gate of IGBT 102*d* of the ignition coil device 102. When at the timing T1 represented in FIG. 3, the level of the control signal A is changed from a low level (referred to as L level, hereinafter) to a high level (referred to as H level, hereinafter), IGBT 102*d* turns ON and a primary current I1 flows in the primary coil 102*a* through the path consisting of the battery, the primary coil 102*a*, IGBT 102*d*, and the GND, in that order.

When the primary current I1 flows in the primary coil 102*a,* magnetic energy is stored in the iron core 102*c* of the ignition coil device 102. When at the timing T1, the primary current I1 starts to flow in the primary coil 102*a*, a voltage is induced across the secondary coil 102*b*, and the voltage across the secondary coil 102*b* continues to rise in the positive direction until the iron core 102*c* is magnetically saturated; however, the voltage rise is not represented in the waveform of the central-electrode voltage B in FIG. 3.

Next, when at the timing T2, the level of the control signal A is changed from H level to L level, IGBT 102*d* turns OFF and the primary current I1 that has been flowing in the primary coil 102*a* is cut off, so that release of the magnetic energy stored in the iron core 102*c* begins. Due to the release of the magnetic energy, charging of the to-the-ground static capacity formed of the ignition plug 101 and the like is started, so that the voltage applied to the central electrode 101*a* increases in the negative direction as represented in the waveform of the central-electrode voltage B in FIG. 3.

Next, at the timing T3, the central-electrode voltage B reaches a breakdown voltage, which is a predetermined high voltage; a dielectric breakdown is caused in the gap between the central electrode 101*a* and the GND electrode 101*b*, resulting in a spark discharge; then, the discharge current C instantaneously flows between these electrodes. The discharge electrode C flows through the path consisting of the GND electrode 101*b*, the central electrode 101*a*, the secondary coil 102*b*, the first Zener diode 201, the capacitor 202, and the GND, in that order, thereby charging the capacitor 202.

After a discharge begins at the timing T3, the central-electrode voltage B almost instantaneously lowers from the breakdown voltage to a discharge maintaining voltage. The discharge between the central electrode 101*a* and the GND electrode 101*b* is maintained by the discharge maintaining voltage. In this situation, the time between the timings T3 and t4 is a discharge duration t. At the timing t4, the charging voltage across the capacitor 202 reaches the breakdown voltage of the second Zener diode 203; the discharge current C flows to the GND by way of the second Zener diode 203; then, the discharge between the central electrode 101*a* and the GND electrode 101*b* stops.

At the timing T4, the discharge between the central electrode 101*a* and the GND electrode 101*b* stops; however, after the timing T4, the voltage that has been charged across the capacitor 202 is applied, as a bias voltage V0, to the central electrode 101*a*. However, in the case where no smolder is produced, for example, on the surface of the insulating supporter 101*c* between the central electrode 101*a* and the GND electrode 101*b*, no leakage current caused by a smolder flows in the space between the central electrode 101*a* and the GND-level portion. Accordingly, as the output voltage D of the current detection device 104, there is generated only a mount-shaped voltage 301 based on a current that flows through ions produced by combustion immediately after the timing T4 at which the discharge ends; when the ions disappear, the output voltage D becomes "0".

Next, the case where a smolder is produced in the ignition plug 101 will be explained. When due to a smolder, a conductive substance is formed, for example, on the surface of the insulating supporter 101*c* between the central electrode 101*a* and the GND electrode 101*b*, a leakage current flows to the GND through the path consisting of the capacitor 202, the resister 204, the secondary coil 102*b*, the central electrode 101*a*, a leakage path produced by the conductive substance caused through the smolder, and the GND electrode 101*b*, in that order. The leakage current is detected, as a potential difference across the resister 204, by the operational amplifier 301; the output voltage Dl corresponding to the value of the detected potential difference is outputted from the current detection device 104.

MPU 302 receives the output voltage D1 outputted from the current detection device 104 by way of the A/D converter 303 in the smolder level detection device 105; based on the output voltage D1, the smolder level is calculated. The method of calculating the smolder level will be described later.

Figure 4:
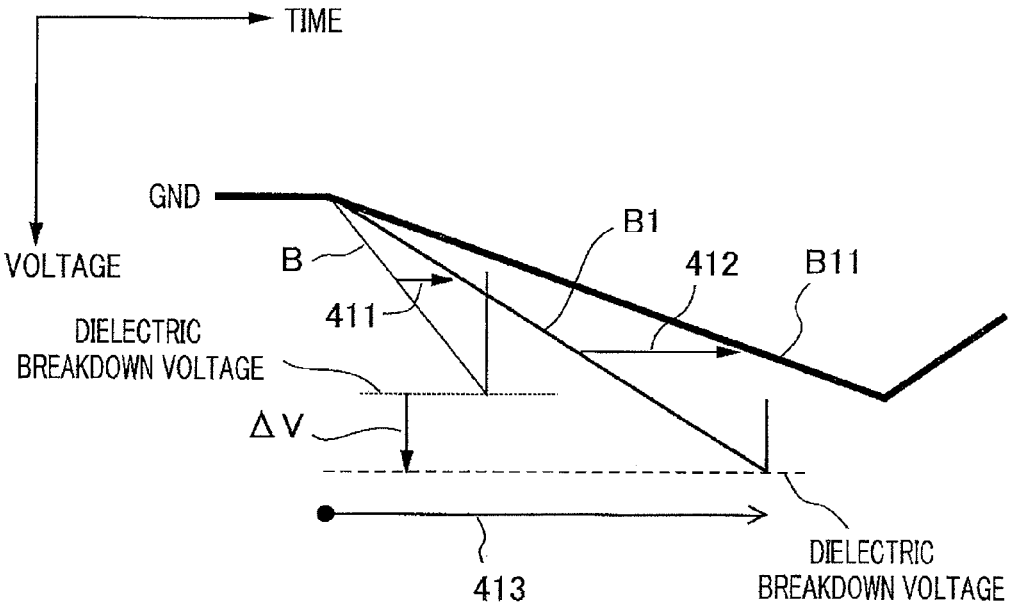
FIG. 4 is an explanatory chart representing the voltage waveform of the central electrode of an ignition plug.

Here, there will be explained the central-electrode voltage at a time when a smolder is produced in the ignition plug 101 and an energy leakage path is formed in the space between the central electrode 101*a* and the GND. FIG. 4 is an explanatory chart representing the voltage waveform of the central electrode of an ignition plug; the ordinate denotes the voltage value, and the abscissa denotes the time.

In order to produce a flashover between the central electrode 101*a* and the GND electrode 101*b*, it is required that as described above, mainly the to-the-ground static capacity formed between the central electrode 101*a* and the GND-level portion is charged, as represented in FIG. 4, up to the dielectric breakdown voltage. In the case where no leakage path is formed between the central electrode 101*a* and the GND-level portion, the thinnest solid line in FIG. 4 represents the temporal transition of the central-electrode voltage B in a time from a time instant when the charge of the to-the-ground static capacity is started to a time instant when the dielectric breakdown voltage is reached.

However, in the recent years, there has been a tendency that for the purpose of improving the thermal efficiency of an internal combustion engine, the compression ratio of the internal combustion engine is raised; therefore, the pressure inside a cylinder is extremely high when the piston is approximately at the top death center. Accordingly, as described in Paschen's Law, the dielectric breakdown voltage increases by ΔV corresponding to the increase in the pressure inside the cylinder. In other words, in the case where the pressure inside the cylinder rises when the piston is approximately at the top death'center and hence the compression ratio of the internal combustion engine becomes high, the foregoing flashover is caused; thus, more energy is required.

There has been a tendency that the shape of the ignition plug becomes thinner and the length thereof becomes longer as the structure of an internal combustion engine becomes more complex; this fact, at the same time, leads to the increase in the to-the-ground static capacity of the ignition plug. When the to-the-ground static capacity of the ignition plug increases, the speed of charging the to-the-ground static capacity decreases and hence the time instant when the charging is completed is delayed along the direction indicated by the arrow 411; due to this delay and the foregoing increase ΔV in the dielectric breakdown voltage, the energy required for the dielectric breakdown voltage to be reached largely increases. The middle-thick solid line in FIG. 4 represents the temporal transition of the central-electrode voltage B1 before it reaches the dielectric breakdown voltage to which ΔV has been added. In this case, the time from a time instant when the charging is started to a time instant when the dielectric breakdown voltage is reached becomes largely long. The waveform of the central-electrode voltage B1 represented in FIG. 3 corresponds to the waveform of the central-electrode voltage B1 represented by the middle-thick solid line in FIG. 4.

When under the foregoing severe environment, a smolder causes a leakage path to be produced in an ignition plug, the time instant when the charging is completed is further delayed along the direction indicated by the arrow 412; the central-electrode voltage is represented as the curve B11 indicated by the thickest solid line in FIG. 4. In these cases, the central-electrode voltage B11 often does not reach the dielectric breakdown voltage as represented in FIG. 4; or, even if the central-electrode voltage B11 reaches the dielectric breakdown voltage under these circumstances, the timing when the dielectric breakdown voltage is reached is largely delayed from the anticipated timing, whereby the output of the internal combustion engine decreases and the residual magnetic energy also decreases.

The waveform of the central-electrode voltage B1 represented in FIG. 3 shows the case where although the dielectric breakdown voltage is reached and the dielectric breakdown is caused, the timing of the dielectric breakdown is largely delayed from the anticipated timing, i.e., it shows that the discharge duration t1 represented as a period from the timing T13 to the timing T14 becomes extremely short. In these cases, no flame kernel having a sufficient strength can be produced; therefore, the probability that incomplete combustion is caused or the flame propagation speed decreases is raised.

Figure 5:
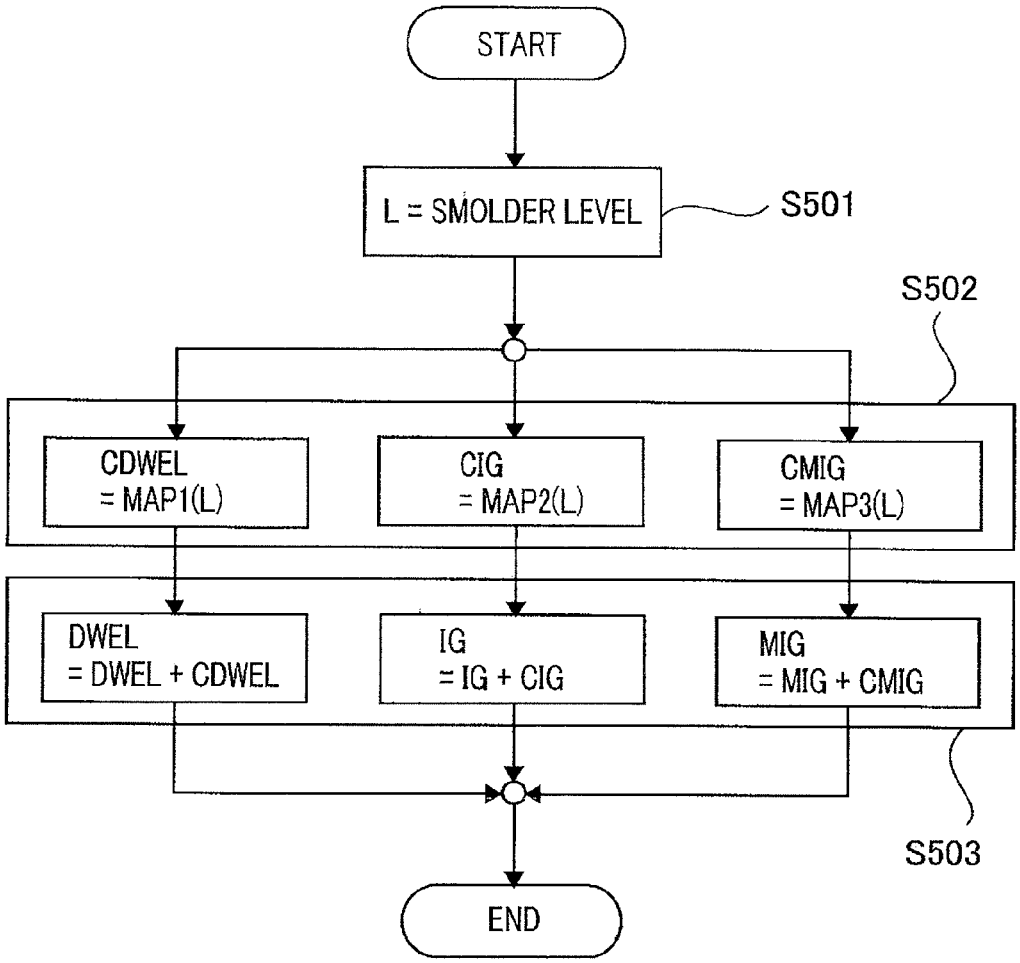
FIG. 5 is a flowchart representing the operation of an ignition control apparatus according to Embodiment 1 of the present invention.

The ignition control apparatus according to Embodiment 1 of the present invention can solve the foregoing problems at a time when a smolder is produced. FIG. 5 is a flowchart representing the operation of an ignition control apparatus according to Embodiment 1 of the present invention. In FIG. 5, in the step S501, the smolder level detection device 105 calculates a smolder level L, based on the output voltage of the current detection device 104. In the case where no smolder is produced, no discharge current flows, as represented by the waveform of the discharge current C in FIG. 3; therefore, the output voltage of the current detection device 104 is "0", and hence the smolder level L is "0". In addition, as described above, immediately after the timing T4 at which the discharge ends, a mount-shaped waveform 301 is produced as the output voltage of the current detection device 104; however, this waveform 301 is produced based on the signal of a current that flows through ions generated by combustion, and is not a signal for indicating the smolder level.

In the case where a smolder is produced, the bias voltage V0 based on the voltage across the foregoing capacitor 202 is applied to the central electrode 101*a* in the duration other than the ignition discharge operation duration from T1 to T14; thus, by way of a leakage path formed of the smolder, a leakage current flows from the central electrode 101*a* to the cylinder block, of the internal combustion engine, that is a GND-level portion. Therefore, in the duration other than the ignition discharge operation duration from T2 to T14, the output voltage D1 of the current detection device 104 becomes a value approximately corresponding to the smolder level L.

Immediately after the timing T4, the output voltage D1 of the current detection device 104 includes the waveform 301 caused by combustion; because it is difficult to distinguish a leakage signal from the waveform 301, the smolder level detection device 105 calculates the smolder level L by reading the voltage value at a time instant in the vicinity of the timing T15 at which combustion has been completed or at a time instant in the vicinity of the timing T10 at which the combustion has not been started.

The smolder level L is expressed, for example, by a resistance value; assuming that the charging voltage across the capacitor 202 is 100[V], the resistance value of the resister 204 is 1 [kΩ], the resistance value of the primary coil 102*a* is 5[kΩ], and the value of the output voltage D1 of the current detection device 104 is 1[V], the smolder level L is calculated through the following equation.

$$L=(100[V]-1[V])\div\{(1[V]\div(1\ [k\Omega]+5\ [k\Omega])\}=594\ [k\Omega]$$

Here, as far as the smolder level L is concerned, the smaller its value is, the higher the smolder level is.

In addition, the smolder level L may be expressed by the value of a leakage current or by the value of a voltage across the resister 204, instead of a resistance value. In this case, the larger the value of the smolder level L is, the higher the smolder level is.

In the step S501 in FIG. 5, the smolder level L, calculated in such a manner as described above by the smolder level detection device 105, is obtained; then, the step S501 is followed by the step S502. In the step S502, from preliminarily stored maps MAP1, MAP2, and MAP3, there are obtained an energization time correction amount CDWEL, a cutoff timing correction amount CIG for cutting off the energization, and an ignition count correction amount CMIG corresponding to the smolder level L obtained in the step S501.

That is to say, the foregoing map MAP1 is a map in which corresponding to the value of the smolder level L, there is set the energization time correction amount CDWEL for correcting the output time of the control signal A represented in FIG. 3, i.e., the energization time (from T1 to T2) of the primary current I1 that flows in the primary coil 102*a;* the map MAP2 is a map in which corresponding to the value of the smolder level L, there is set the cutoff timing correction amount CIG for correcting the timing T2 at which the energization of the primary current I1 is cut off; the map MAP2 is a map in which corresponding to the value of the smolder level L, there is set the ignition count correction amount CMIG for correcting the ignition count during a single power stroke of an internal combustion engine. The ignition count during a single power stroke of an internal combustion engine corresponds to the number of events, during a single power stroke, in which the control signal A represented in FIG. 3 turns from H level to L level.

Next, in the step S503, based on the foregoing correction amounts obtained in the step S502, the respective control amounts are corrected. That is to say, the control device 103 generates a new energization time control amount CDEL obtained through the duration from the timing T21 to the timing T22, by correcting the period (time) from the timing T1 to the timing T2 corresponding to an uncorrected energization time control amount DWEL, based on the energization time control amount CDWEL. Moreover, the control device 103 generates a new cutoff timing control amount IG, by correcting an uncorrected cutoff timing control amount IG corresponding to the timing T2, based on the cutoff timing correction amount CIG. Furthermore, the control device 103 generates a new ignition count control amount MIG, by correcting an uncorrected ignition count control amount MIG, based on the ignition count correction amount CMIG. FIG. 3 represents a case where as for the ignition count, one-time ignition is corrected to multi-time ignition (two-time ignition). The control device 103 controls the ignition coil device 102 based on these generated control amounts.

Next, the operation of the ignition control apparatus according to Embodiment 1 of the present invention will further be explained with reference to the timing chart in FIG. 3. In FIG. 3, in the case where no smolder is produced, the control signal that is supplied from the control device 103 to the ignition coil device 102 has a waveform represented as the control signal A; however, in the case where a smolder is produced, the smolder level detection device 105 calculates the smolder level L, so that the control device 103 generates the new control signal A2 obtained by performing correction in such a manner as described above, in accordance with the smolder level L.

In other words, when a smolder is produced, a dielectric breakdown requires a large energy, as described above. Accordingly, in order to lengthen the energization duration DWEL, which is a time for accumulating magnetic energy in the ignition coil device 102, the timing at which the control signal A2 is raised from L level to H level is advanced from T1 to T21, by correcting the energization duration DWEL at a time when no smolder is produced, based on the energization time correction amount CDWEL.

When a smolder is produced, the time in which the dielectric breakdown voltage is reached becomes longer, as described above; thus, the cutoff timing IG for the primary current I1 that flows in the primary coil 102*a* is corrected in such a way as to advance, for example, from T2 to T22. In such a way as described above, the timings of the dielectric breakdown, i.e., the so-called ignition timings T3 and T23 can be set at approximately the same time instant.

In the case where no smolder is produced, the discharge duration t immediately after a flashover is a period from the timing T3 to the timing T4; however, in the case where a smolder is produced, the timing T13 of the dielectric breakdown is delayed and hence the residual magnetic energy decreases. As a result, the discharge duration t1 becomes a period from the timing T13 to the timing T14, whereby it becomes shorter than its counterpart at a time when no smolder is produced. Accordingly, multi ignition is performed so that the energy at a time when a smolder is produced becomes the same as the energy that is supplied to an inflammable fuel-air mixture when no smolder is produced. In the example represented in FIG. 3, ignition is performed twice.

That is to say, after the first ignition is performed at the timing T23, the level of the control signal A2 is raised from L level to H level at the timing T24 so that the primary current I1 is applied to the primary coil 102*a* and hence magnetic energy is again accumulated in the ignition coil device 102. Then, at the timing T25, the control signal A2 is lowered from H level to L level in order to cut off the primary current I1 so that the accumulated magnetic energy is again released and the second ignition is performed. In this case, because a flashover has been already produced at the timing T13, the second ignition is performed at the timing T25 only by raising the voltage of the central electrode 101*a* up to the discharge maintaining voltage. Then, the discharge is ended at the timing T26.

In the case of this multi ignition, the discharge duration t2 is given by the following equation.

$$t2(T3 \text{ to } T4) \approx t21(T23 \text{ to } T24) + t22\ (T25 \text{ to } T26)$$

Here, after and including the second ignition, the energization duration (T24 to T25) of the primary current I1 may be a predetermined fixed value; alternatively, a value determined in accordance with the smolder level L may preliminarily be set in a map, or a variable may be adopted, instead of the map.

As described above, the ignition control apparatus according to Embodiment 1 of the present invention makes it possible that even when a smolder is produced, there can be performed ignition that is equivalent to ignition at a time when no smolder is produced.

An ignition control apparatus according to the present invention is mounted in an automobile, a motorcycle, an outboard engine, an extra machine, or the like utilizing an internal combustion engine, and is capable of securely performing appropriate ignition even when a smolder is produced in an ignition plug; therefore, extinction of the internal combustion engine can be prevented, and decrease in the output can be suppressed. As a result, deleterious components are prevented from being exhausted to the air, and the fuel consumption can be prevented from increasing; thus, the present invention can contribute to environment preservation.

Various modifications and alterations of this invention will be apparent to those skilled in the art without departing from the scope and spirit of this invention, and it should be understood that this is not limited to the illustrative embodiments set forth herein.

What is claimed is:

1. An ignition control apparatus comprising:

an ignition plug that is provided with a first electrode and a second electrode that face each other by the intermediary of a gap and that produces a spark discharge in the gap so that an inflammable fuel-air mixture inside a combustion chamber of an internal combustion engine is ignited, when a predetermined high voltage is applied to the first electrode;

an ignition coil device that is provided with a primary coil and a secondary coil magnetically coupled with the primary coil and connected with the first electrode, that accumulates energy, based on energization of the primary coil, that cuts off energization of the primary coil so as to release the accumulated energy and hence to generate a predetermined high voltage to the first electrode;

a current detection device that applies a bias voltage to the first electrode and detects a current that flows in the first electrode, based on the applied bias voltage;

a smolder level detection device that detects a level of a smolder produced in the ignition plug, based on a value of the current detected by the current detection device; and a control device that controls, based on a smolder level detected by the smolder level detection device, at least one of the timing of ignition, the number of ignition events per power stroke of the internal combustion engine, and the amount of energy accumulated in the ignition coil device so that the ignition is implemented, wherein at least one from among a first map, a second map, and a third map is provided, wherein in the first map there is set a correction amount for correcting energization duration for the primary coil in accordance with the value of the current detected by the current detection device, in the second map there is set a correction amount for correcting timing of cutting off energization of the primary coil in accordance with the value of the current detected by the current detection device, and in the third map there is set a correction amount for correcting the number of ignition events in accordance with the value of the current detected by the current detection device, wherein based on a smolder level detected by the smolder level detection device, the control device controls at least one of the timing of ignition, the number of ignition events, and the amount of energy accumulated in the ignition coil device, by controlling energization of the primary coil, wherein the control device controls energization of the primary coil in such a way as to correct at least one of the timing of ignition, the number of ignition events, and the amount of energy accumulated in the ignition coil device, based on the correction amount obtained from at least one of the maps in accordance with a smolder level detected by the smolder level detection device, wherein in controlling the timing of ignition, the control device performs control in such a way as to advance the timing of ignition, when the detected smolder level becomes higher than a past smolder level, wherein in controlling the number of ignition events, the control device performs control in such a way as to make the number of ignition events larger than the number of past ignition events, when the detected smolder level becomes higher by a predetermined value than a past smolder level, wherein in controlling an amount of energy accumulated in the ignition coil device, the control device performs control in such a way as to make the amount of accumulated energy larger than the amount of energy accumulated in the past, when the detected smolder level becomes higher than a past smolder level, and wherein the control device, the current detection device, and the smolder level detection device are arranged in a single and a same package.

* * * * *